US007901190B2

(12) United States Patent
Gray

(10) Patent No.: US 7,901,190 B2
(45) Date of Patent: Mar. 8, 2011

(54) PUMP CONTROL SYSTEM

(76) Inventor: Ian Gray, Coorparoo (AU)

( * ) Notice: Subject to any disclaimer, the term of this patent is extended or adjusted under 35 U.S.C. 154(b) by 878 days.

(21) Appl. No.: 11/658,634

(22) PCT Filed: Jul. 26, 2005

(86) PCT No.: PCT/AU2005/001092

§ 371 (c)(1),
(2), (4) Date: Jan. 26, 2007

(87) PCT Pub. No.: WO2006/010202

PCT Pub. Date: Feb. 2, 2006

(65) Prior Publication Data

US 2008/0317608 A1 Dec. 25, 2008

(30) Foreign Application Priority Data

Jul. 28, 2004 (AU) ..... 2004904179

(51) Int. Cl.
*F04B 49/00* (2006.01)

(52) U.S. Cl. ..... 417/22; 417/43; 417/141

(58) Field of Classification Search ..... 417/43, 417/36, 38, 137, 141, 22, 44.2; 702/45, 47, 702/50, 55, 127, 138, 140
See application file for complete search history.

(56) References Cited

U.S. PATENT DOCUMENTS 3,973,877 A * 8/1976 Taki ..... 417/38
4,124,331 A 11/1978 Taki
5,244,351 A 9/1993 Arnette
5,259,733 A * 11/1993 Gigliotti et al. ..... 417/38
5,464,327 A 11/1995 Horwitz
5,580,221 A 12/1996 Triezenberg
5,636,971 A * 6/1997 Renedo et al. ..... 417/5
5,738,495 A * 4/1998 Carmignani et al. ..... 417/44.1
7,066,197 B1 * 6/2006 Gray et al. ..... 137/357

FOREIGN PATENT DOCUMENTS

| | | | |
|---|---|---|---|
| EP | 0614010 | B1 | 1/1999 |
| JP | 08-144960 | A | 6/1996 |
| JP | 08-200282 | | 8/1996 |
| JP | 09-329085 | | 12/1997 |
| JP | 11-022690 | | 1/1999 |
| WO | WO 01/61429 | | 8/2001 |
| WO | WO 03/078839 | A2 | 9/2003 |

OTHER PUBLICATIONS

Derwent Abstract Accession No. G0119 D/26, Oct. 7, 1980, Orlov.

* cited by examiner

*Primary Examiner* — Charles G Freay
*Assistant Examiner* — Todd D Jacobs
(74) *Attorney, Agent, or Firm* — Roger N. Chauza, PC

(57) ABSTRACT

A pumping system in which a pump (5) is controlled by a programmed controller (22) in response to input signals from an inlet pressure transducer (3) and an outlet pressure transducer (15) and in certain circumstances inputs from various flow sensors (4,19). The controller (22) can be programmed to allow the pump (5) to prematurely operate before an outlet pressure reaches a low pressure threshold, when usage of the liquid is high. The controller (22) can be programmed to detect a lack of prime of the pump (5), to restore prime once the pump (5) has lost prime, and to prevent successive on/off pump cycles when the outlet flow is continuous and at a moderate or low level.

19 Claims, 8 Drawing Sheets

PUMP CONTROL SYSTEM

BACKGROUND OF THE INVENTION

Small water supply systems typically draw water from a reservoir of some sort and pressurise it by means of a pump which discharges the water into a plumbing circuit. Many industrial systems pump liquids other than just water by similar means. To avoid having to run the pump continuously, the pump usually discharges through a non-return valve to a plumbing circuit which incorporates a hydraulic accumulator which is a pressurised storage vessel. Also incorporated into the circuit downstream of the non return valve is a pressure sensitive switch which turns the pump on and off. The switch is designed to turn the pump on at some lower pressure and to turn it off when the pressure exceeds a higher pressure. If the flow from the plumbing circuit is sufficient, then the pressure in the circuit will not exceed the higher pressure threshold and the pump will continue to run. If a tap or other means of drawing flow from the circuit is opened, then flow will be driven through it by the liquid stored under pressure in the accumulator without the need for the pump to run. A lowered pressure is a trigger to turn the pump on.

The type of pump frequently used in such systems is a centrifugal pump with an electric motor which is either on or off. Such a system is of low cost but lacks control.

In this type of system there are problems with pressure fluctuations and associated flow fluctuations brought about by turning the pump on and off. In the case where liquid is drawn from the plumbing circuit at a high rate, the pump will not turn on until the pressure has reached the lower threshold pressure.

In the case where liquid is drawn from the circuit at a rate lower than the pump's capacity at the delivery pressure, then the pressure in the circuit will decline to the lower threshold pressure upon which the pump will be turned on and the pressure will rise to the higher threshold pressure. At this pressure, the pump will be turned off. This process may be repeated. The pressure fluctuations in the supply are annoying to the user as is the noise of the pump turning on and off. The mechanical and electrical demands of this on and off switching are deleterious to the pumping equipment.

Another problem encountered by the system described occurs when the pump loses prime. This is caused by a loss of fluid through the pump. The pump may then spin but cannot develop pressure. The only way to avoid this problem is to ensure an adequate liquid supply to the pump.

It is however desirable in some situations to totally empty the reservoir such as for cleaning purposes. After such a situation, the pump has lost prime the only way for it to regain prime is for it to be refilled with fluid. The most effective way to achieve this is to ensure that the pump has fluid available at a positive pressure at its inlet and an unrestricted outlet. By turning the pump on the air in the pump is displaced by fluid and the loss of prime situation is overcome.

Many small commercial liquid supply pumps are protected from the effects of loss of prime by a temperature sensor located on the pump motor. Continuous running caused by a failure to build pressure leads to heating of the motor. The temperature rise is detected and the motor is turned off until the temperature has dropped. This system has many limitations as the pump may still be driven in the dry condition when it is cool, thus leading to energy loss and wear of the pump seals.

Knowing the level of liquid in the reservoir is important to good pump control as loss of prime may be avoided by not drawing down the liquid level too low. It may also be used to prevent the turning on of a pump in the event that the liquid level is too low. Measurement of the liquid level has been achieved by the use of float switches, echo meters or changes in resistance or capacitance of sensors installed in the reservoir.

SUMMARY OF THE INVENTION

The invention incorporates much of the equipment that is used in conventional liquid supply pumping systems. In one embodiment, liquid is stored in a reservoir that is drawn through a pump and delivered via a non-return valve to a plumbing circuit that incorporates a hydraulic accumulator. The pump that would normally, but not exclusively, be used would be of a centrifugal type that is driven by an electric motor that is either on or off. These pumps generally have poor priming characteristics and would normally not prime without fluid at the inlet to the pump. For these pumps to operate effectively, they need to either to have their inlet conduits primed, or operate with the reservoir from which they draw fluid generally at a higher level than the pump.

What is different is the means of control of the pump. This is achieved, according to one embodiment, through the use of sensors and a controller module. The sensors used are a low pressure sensor in the inlet circuit of the pump, a high pressure sensor in the outlet circuit beyond the non-return valve, and ideally a flow sensor at the outlet. A flow sensor may be also be advantageously incorporated into the inlet circuit.

Whilst the use of flow sensors is highly desirable, the cost of providing such a sensor that is accurate at a range of flows is quite high and may not be economically practical in many applications. Flow sensing may however be achieved also by an examination of the pressure transducer values.

An additional pressure transducer may be located to measure the outlet pressure of the pump, in which case it would be connected into a port close to the pump outlet.

The presence of this transducer has particular use in determining the state of prime of the pump.

The low pressure transducer may be located directly on the reservoir. In this case it will measure liquid head directly and hence the stored volume of liquid in the reservoir may be computed by the controller. The low pressure transducer may however be advantageously located near the inlet to the pump. In this case it will measure the liquid head above it and hence stored volume of liquid under no flow conditions. When flow is being drawn from the reservoir the pressure recorded by the low pressure transducer will be depressed due to pressure losses induced by flow in the conduit from the reservoir. As such, the pressure depression may be directly related to the flow. This is a good indicator of higher flows but because the pressure depression is related to the square of the flow rate, it is not so accurate at lower flow rates. A highly accurate pressure transducer may however achieve adequate determination of flow.

The high pressure transducer is attached to the downstream side of the non-return valve. The high pressure transducer is used to measure pressure in the plumbing circuit. The use of a pressure transducer rather than a switch in this location brings significant benefits. It permits a continuous sensing of pressure that enables the rate of change of pressure to be deduced. This has particular benefits as will be described.

In the event that pressure is drawn down rapidly by a demand on the plumbing circuit, it is desirable to turn the pump on as quickly as possible so as to avoid the pressure declining to a low level. This may be achieved by sensing the rate of pressure decline in the outlet plumbing circuit. Thus, the controller monitors the high pressure sensor and if the pressure decline rate is sufficiently rapid, it turns on the pump even if the pressure has not yet reached a lower threshold. The advantage of this is reduced pressure fluctuation and hence more even flow rate.

If the out flow sensor is incorporated, it may be used to sense flow directly and a rate chosen to turn on the pump before a lower pressure threshold is reached. By such means it achieves the same result of reduced pressure fluctuation.

A sensitive out flow sensor may also be used to detect low flow levels that may cause cycling between high and low pressures. In this case the controller is used to read the flow sensor and to determine if the flow rate is low enough to turn the pump off as the pressure declines from the high level to a lower threshold, or alternatively determine if the flow rate is high enough to leave the pump on to avoid cycling.

The high pressure sensor may also be used to detect a low flow situation that would cause cycling between high and low pressure thresholds. This may be achieved by three methods.

The first of these is to measure the time taken to pass from a high pressure threshold to a stable pressure. This time is indicative of the flow rate. It is accurate because the delivery characteristic of the pump is much reduced at high pressures.

The second method is to simply measure the peak pressure reached. For this to operate successfully the pump characteristic needs to be very well known and compensated for the temperature of the fluid and the pump, and for fluctuations in the pump power supply.

The third method is to turn the pump off and detect the pressure decline rate. This corresponds to outflow once the effect of cooling of the accumulator gas from near adiabatic compression to isothermal conditions is taken into account. If a pressure decline is detected then the pump can be turned on and held for a pre-programmed period before being switched off, and the pressure decline tested again. It is possible to extend the length of the pre-programmed period with each re-test of pressure decline. This is the least favoured option because it entails multiple pump starts.

The sensing system disclosed may be used to detect and recover from a situation where there is loss of pump prime. If the pump is operating and there is an insignificant pressure difference between a pressure transducer at the pump inlet and one directly at the pump outlet, then this is indicative of a situation of no prime.

If the pump is on and pressure is declining at the high pressure transducer and reaches the minimum static head permitted by the downstream plumbing, then it may be deduced that the pump is not pumping effectively, probably due to a lack of prime. If at the same time the low pressure transducer near the pump inlet detects a pressure that approaches and reaches that associated with an empty reservoir, then it can be reliably concluded that the pump has lost prime. In a typical water supply situation with a pump delivering water from a tank at a higher level than the pump, then this inlet pressure would correspond to atmospheric pressure. If however the inlet plumbing contained a U-bend, then the possibility exists for the pressure to be negative. This has occurred because the pump has drawn water from the reservoir and has pulled through a slug of air which has caused the pump to loose prime and fail to generate a vacuum. The water in the inlet conduit settles back to and generates a negative inlet pressure (with respect to atmospheric pressure) at the pump inlet. This is because the presence of the non-return valve above the outlet of the pump prevents pressure balancing to occur. In the event of loss of prime as deduced by measuring these characteristics, the pump will be turned off to prevent pump damage and save energy.

To recover from loss of prime, there needs to be liquid at the inlet to the pump. This may be detected by positive pressure at the low pressure transducer. If liquid is available at the impeller and the pump is turned on, it will generate a small positive pressure at its outlet. The pressure generated depends on the individual pump configuration and the amount of liquid that enters the pump. This pressure soon reaches a stable state which is accompanied by zero draw down (and hence pressure drop) at the pump inlet. The detection of this stable pressure state is a cause to turn the pump off. A small pressure is maintained in the accumulator. If there is positive pressure at the inlet pressure transducer, indicating a positive head, and pressure drops due to liquid being drained out of the downstream plumbing, then this is a signal for the controller to turn the pump on. The pump pressure will not reach full operating pressures until the air is cleared from the pump. This can only be achieved by an adequate liquid flow rate over an adequate time brought about by a low back pressure downstream of the system.

A problem may arise where-the pump discharges into a pipe with significant head before a draw off point. In this case, a head may be maintained over the non-return valve that is higher than the pump can generate when not fully primed. In this case, no flow occurs and the pump cannot clear itself of air and become primed. The solution to this is to open a valve at a sufficiently low level above the pump outlet and before the non-return valve, so that the pump may discharge through it at a low pressure. This may also be undertaken manually. Alternatively, an embodiment of the invention includes an automatically operated de-airing valve for this purpose.

This de-airing valve is operated by the controller. It is held open until the parameters measured at the transducers correspond to the pump operating in the primed state. In a system with a high and low pressure transducer, this will correspond to a drawn down pressure at the inlet and some pressure at the pump outlet. The de-airing valve could advantageously be an electrically operated solenoid valve.

It is advantageous to protect the pump motor by incorporating a voltage sensor into the controller that will protect the pump motor from over and under supply voltage circumstances. It is also beneficial to attach a temperature sensor to the pump motor and to use the controller to monitor the motor temperature. In the event that the pump. motor becomes excessively hot, the pump can be shut down by the controller before any damage occurs. Also, in the event that the temperature drops low enough to lead to the pumped fluid freezing, the pump motor can be prevented from starting.

According to one embodiment of the invention, included is a pump with a non-return valve downstream of the pump outlet, and a hydraulic accumulator downstream of the non-return valve. The system uses a controller that reads at least a low pressure sensor on the inlet side of the pump and a high pressure sensor that measures pressure on the downstream side of the non-return valve. Usefully, the controller also monitors the mains supply voltage to the pump motor and the pump motor temperature. Where costs are justified, the controller may also monitor flow rate to the system or from the system using a flow meter. In some cases both flow meters may be used. In another embodiment of the invention, an additional pressure transducer may be connected to the pump outlet below the non-return valve. In cases where the pump is running and the pressure measured at the inlet is not significantly different from that at the outlet, then a state of loss of prime has occurred and can be deduced from the comparison of these two pressures by the controller.

The system may also enable lack of prime situations to be remedied by including a de-airing valve that is placed close to the pump outlet and that is opened by the controller. Its purpose is to enable liquid to easily flow through the pump so as to clear air from the pump.

The controller reads the transducers and makes decisions as to whether to turn the pump on or off. It can also operate a de-airing valve if this is fitted. The control functions enable:

(a) The determination of liquid level in the reservoir. (b) Smoother delivery of liquid by turning on the pump in response to rapid demand before the outlet pressure reaches a low pressure threshold. (c) The prevention of pump cycling in the event of low flow. (d) Detection of loss of prime and pump protection in this circumstance. (e) The regaining of prime by the system.

DETAILED DESCRIPTION OF THE INVENTION

Figure 1:
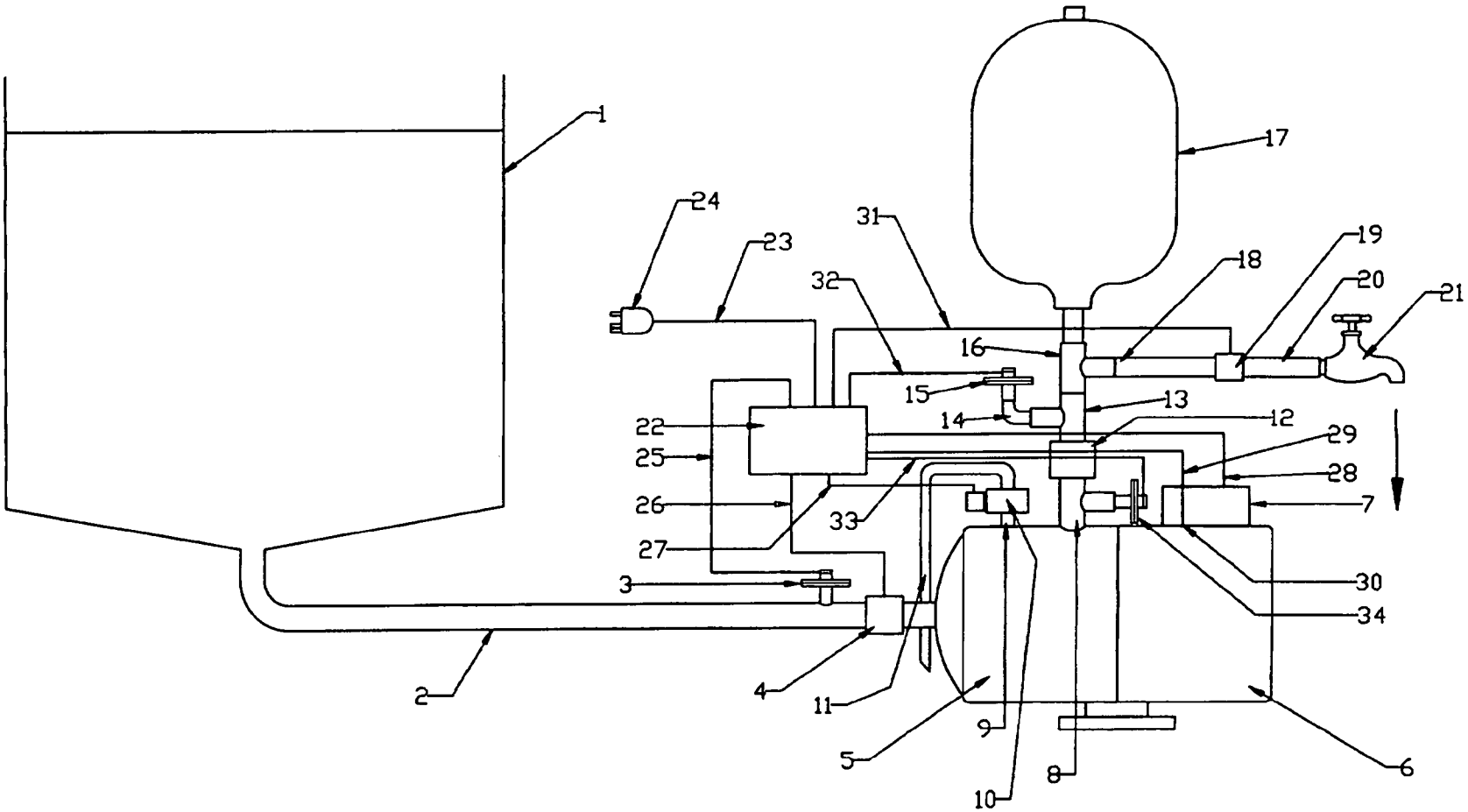
FIG. 1 is schematic drawing of the components according to one embodiment of the invention.

FIG. 1 is a schematic drawing of the components of a pump system according to one embodiment of the invention. Shown is a reservoir in the form of a tank (1) with an outlet to conduit (2). Attached via a port to this conduit (2) are a pressure transducer (3) and an optional flow meter (4). The conduit (2) feeds liquid into a pump (5), shown as a centrifugal type pump, which is driven by an electric motor (6) equipped with a terminal box (7). This particular pump (5) is of a centrifugal type with a main outlet port (8) and de-airing port (9). The purpose of the de-airing port (9) is normally to manually bleed air out of the pump impeller housing. This port is normally blocked. Above the main outlet port (8) is a non-return valve (12). It should be appreciated that pumps not fitted with de-airing port (9) could equally well be bled of air by the fitting of a tee between the main outlet port (8) and the non-return valve (12). This tee would be connected to a de-airing valve. In the figure a remotely operated valve (10) is attached to the de-airing port (9). Normally, this valve (10) would be remotely operated by electrical means and would be of a solenoid actuated type. A drain pipe (11) is attached to the outlet of the valve (10). Also shown connected to the outlet port (8) is the pressure transducer (34). Liquid is pumped from the outlet port (8) through the non-return valve (12) and through a tee (13) into another tee (16) and into outlet conduit (18). The pressurised water is then discharged through an optional flow meter (19) and conduit (20) to the plumbing system, represented here by a single tap (21). Also connected to the tee (13) is an elbow (14) and high pressure transducer (15). A hydraulic accumulator (17) is connected to the tee (16). In typical liquid supply applications, the hydraulic accumulator (17) comprises a pressure vessel with a bladder. Either the bladder itself, or the vessel surrounding the bladder, is pre-charged with a gas. As the liquid pressure in the accumulator rises, the gas also contained therein is compressed. Thus the accumulator (17) has a significant storage volume change versus. pressure change characteristic. Other types of accumulators may be employed with the invention.

The controller (22) contains an electronic processing capability. It also contains a means to acquire data from the various transducers in the system (3), (4), (15), (19), (30) and (34). The latter being a temperature sensor designed to sense pump temperature. The controller (22) is programmable and also uses logic to determine whether the pump motor (6) should be turned on or off and to determine whether the valve (10) should be opened to bleed air out of the pump (5) to permit recovery of prime.

The controller (22) is shown powered by mains electricity conducted through electrical plug (24) and cable (23). Cable (25) connects the low pressure transducer (3) to the controller (22). Cable (26) connects the intake flow meter (4) to the controller (22). Cable (27) connects the solenoid valve (10) to the controller (22). Cable (28) supplies power from the controller (22) to the pump's electric motor junction box (7). Cable (29) connects the temperature sensor (30) to the controller (22). Cable (31) connects the downstream flow sensor (19) to the controller (22). Cable (32) connects the high pressure transducer (15) to the controller (22). A further pressure transducer (34) can advantageously be placed to monitor the pump outlet (8) pressure directly. It is connected to the controller by cable (33). As will be described, this has particular benefits in determining the state of prime of the pump.

It should be appreciated that the plumbing details of this system could be changed without affecting the operation of the system. It should also be appreciated that FIG. 1 shows the use of multiple sensors and features. Not all these sensors or features are required in different embodiments of the invention. Rather, a judicious use of features may achieve the desired results of the invention, which include minimised pressure drop during operation, minimisation of pump cycling, and detection of loss of prime and recovery from lack of prime.

Figure 2:
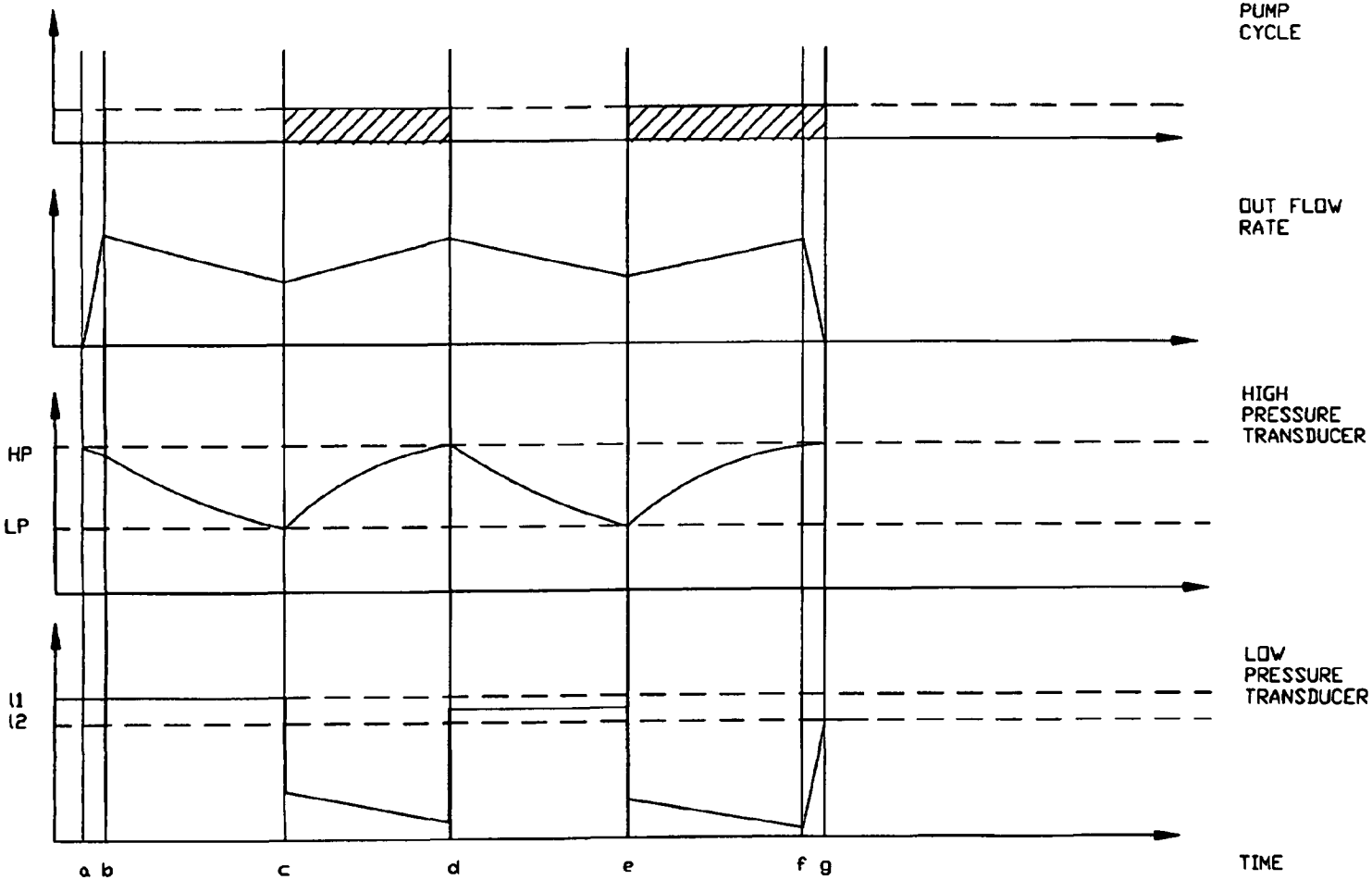
FIG. 2 shows the characteristics of pump cycle without any cycling control measures.

FIG. 2 shows the characteristics of a pump cycle without any cycling control measures. This figure shows four superimposed graphs of the pump cycle, out flow rate as could be measured at flow transducer (19), if fitted, pressure at the high pressure transducer (15) and pressure at the low pressure transducer (3).

The purpose of this graph is to show the transducer outputs as the pump cycles from a high to low pressure state. In this case, a valve (21) is opened at time (a) to be fully open at (b). The outlet pressure measured at transducer marked (15) drops from a high equivalent to the high pressure switch off pressure (labeled HP), to a low at (c) equivalent to the low pressure switch on pressure (labeled LP) when the pump turns on and raises the pressure to time (d). This cycle repeats through (d), (e) and (f) before the valve is turned off and the pump pressure rises to the HP level (g). The low pressure. transducer shows a pressure that is reduced from the original level (11) and corresponds to the pressure drop associated with flow in the inlet conduit due to flow. When the pumping has ceased, the pressure rises to a lowered level (12) corresponding to the drawn down level in the reservoir. If such a system of control were to be implemented in a current form, the controller (22) would read values of pressure from the high pressure transducer (19) utilising an analogue-to-digital converter controlled by a microprocessor. The digitized values of pressure stored by the microprocessor would be compared with pre-programmed values of low and high pressure thresholds. The microprocessor would turn .on the pump motor (6) if the pressure fell below the low pressure threshold and turn off the pump if the pressure reached or rose above the high pressure threshold.

In prior non-programmable electronics, the same result could be achieved by the use of logic circuits using comparators which would compare the pressure transducer output with preset values and would drive the remainder of the circuit to turn the pump on or off.

Figure 3:
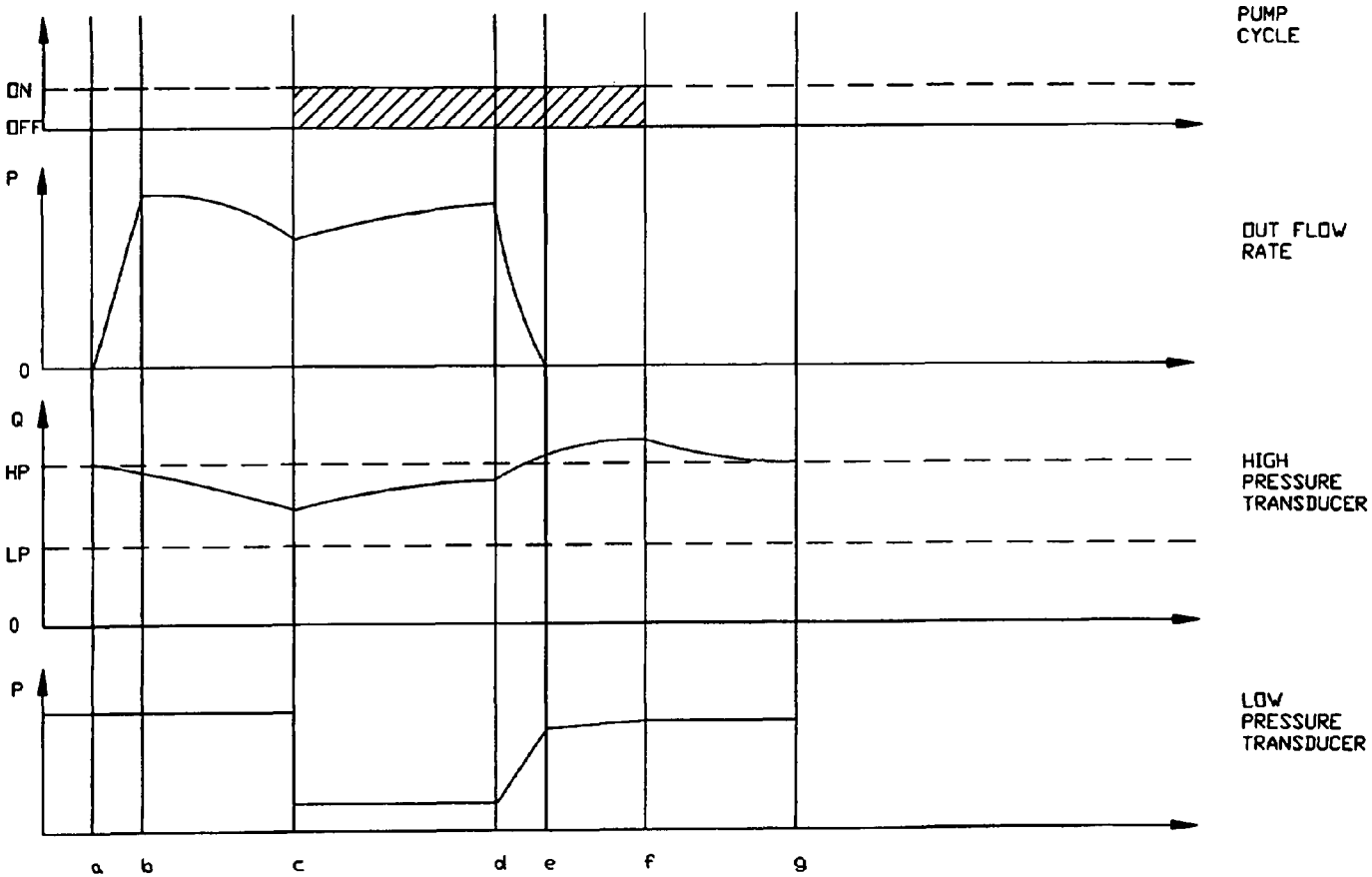
FIG. 3 shows the characteristics of pump cycle when the pump is turned on early to minimise pressure drop in response to rapid draw down.

FIG. 3 shows the characteristics of pump cycle when the pump is turned on early to minimise pressure drop in response to rapid draw down.

This figure shows four superimposed graphs of the pump cycle, out flow rate as could be measured at flow transducer (19), if fitted, pressure at the high pressure transducer (15) and pressure at the low pressure transducer (3).

This enables output pressure to be maintained at a more constant level than the simple pressure threshold system outlined graphically in FIG. 2. As a result, flow rates within the plumbing system would also be more constant.

In this case, flow increases from (a) to (b) corresponding to a tap (21) being turned on. A high flow is produced, driven by the accumulator (17), which displaces fluid as its outlet pressure is allowed to drop. As a result, the pressure at the high pressure transducer (15) declines rapidly. This rapid decline is detected through the high pressure transducer (15), whereupon the pump is turned on at time (c) before reaching the low pressure threshold (LP). As a result of the pump motor (6) being turned on, the pressure rises and flow is maintained. From time (d) to (e) the tap (21) is turned off and the pump is kept on and pressure is allowed to rise above the nominal high pressure threshold until time (f). The pressure then declines due to the cooling of the gas in the accumulator from the adiabatic to isothermal condition at (g).

In practice, the output of the high pressure transducer (15) would be measured or sampled at set intervals by the controller (22), and if the pressure drop between one or more intervals exceeded a certain value it would serve as a trigger to turn the pump on. Because of the non-linear storage pressure versus storage characteristics of the accumulator (17), the threshold rate may need to be adjusted depending on the absolute value of pressure, if a flow dependent pump threshold were chosen.

Alternatively, and for use in non-programmable circuits, the controller (22) could determine the rate of pressure decline of the transducer (15) by the use of a differentiating circuit which would pass a preset threshold in a comparator which would turn on the pump motor (6) by a device, such as a relay.

Figure 4:
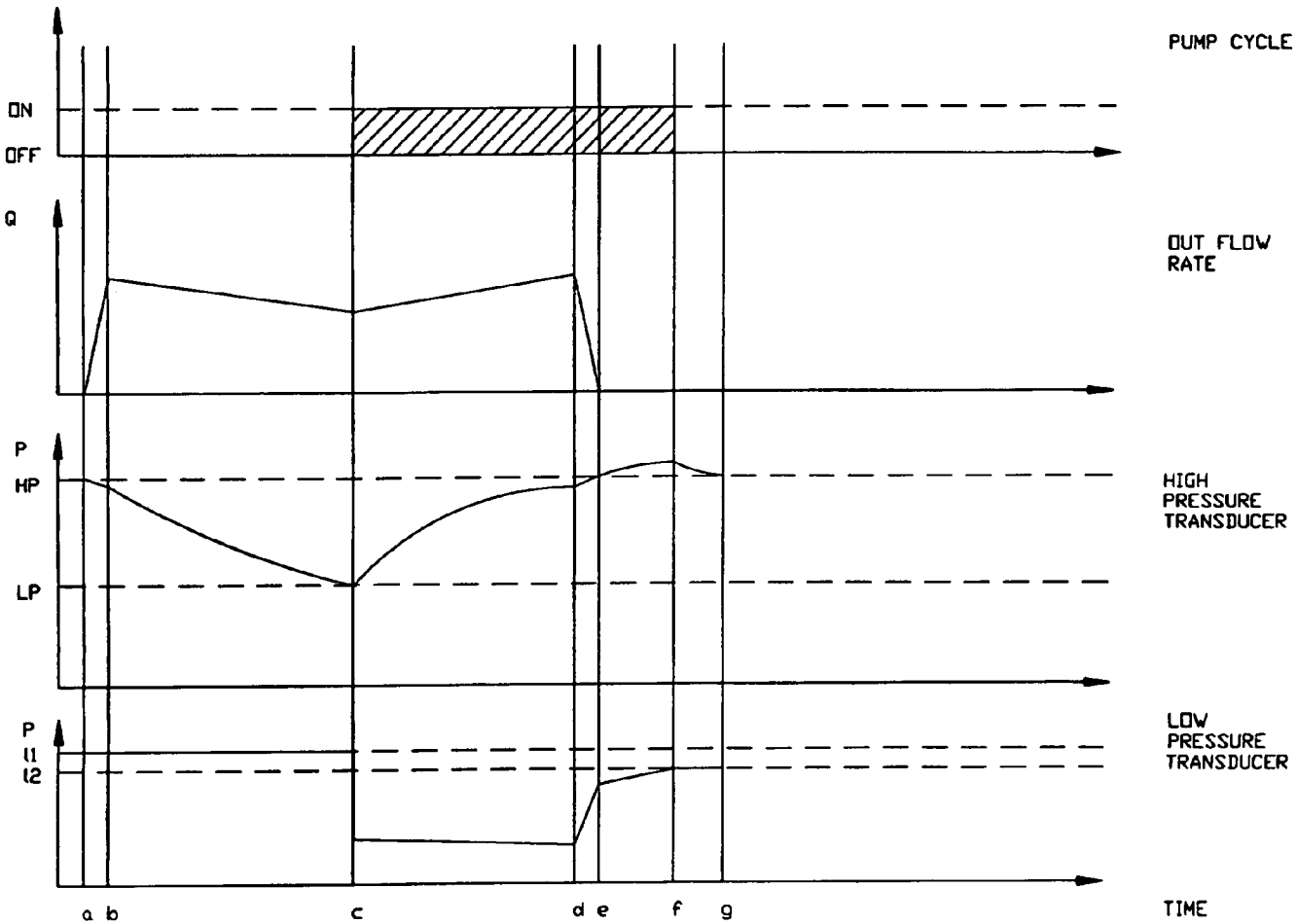
FIG. 4 shows the characteristics of pump cycle using the response of the low pressure transducer which can be used to determine tank level and inflow rate.

FIG. 4 shows the characteristics of a pump cycle using the response of the low pressure transducer (3) which can be used to determine tank level and inflow rate.

The purpose of these graphs is to show the sensor outputs in a normal liquid drawing cycle. Points to note are the change in flow pressure transducer pressure (3) output before and after flow corresponding to a draw down of the reservoir. Also to be noted is the effect of cooling of the accumulator from the state of near adiabatic compression to a cooled state.

In the figure, flow increases from (a) to (b) corresponding to a tap being turned on. The high pressure measured at transducer (15) then declines to the low pressure (LP) at time (c) when the pump is turned on. The tap is turned off between (d) and (e) resulting in zero flow. The flow through the pump declines after this, as the pump is charging the accumulator from (e) to (f). When charged to a predetermined limit, the controller turns off the pump at time (f) and the pressure declines slightly to time (g) while the gas in the accumulator cools from near adiabatic compression.

The flow rate may also be determined by the depression of the pressure measured at the low pressure (inlet) transducer (3) from conditions of no flow to flow. Here, there is a pressure drop caused by flow through the inlet plumbing when the pump turns on. The pressure drop will be dependent on the rate of flow and the nature of the plumbing. This pressure drop could be controlled by the choice of an obstruction in the inlet plumbing. Typically, for a fixed size conduit and/or obstruction, the flow rate will be proportional the square root of the pressure difference between flow and no flow conditions, as measured at the inlet pressure transducer (3).

The reservoir level may be determined by the pressure at the inlet pressure transducer (3) under static conditions. In the case where the reservoir is open to atmospheric pressure, the head over the transducer (3) may be calculated as the gauge pressure divided by the product of gravitational acceleration and the density of the fluid. The volume of fluid contained in the reservoir may be calculated as the integral of the plan area of the reservoir as a function of the head with respect to head change.

Figure 5:
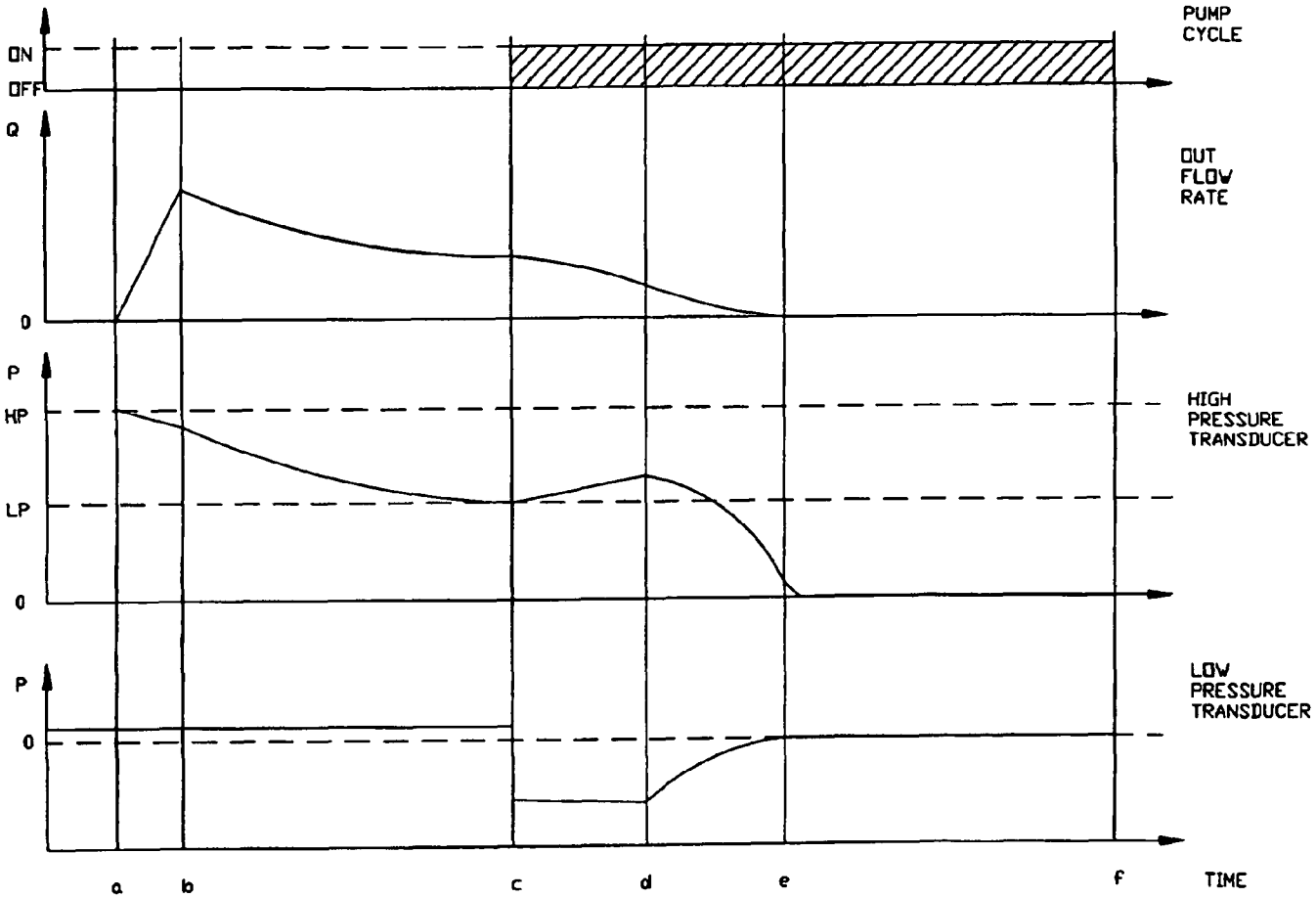
FIG. 5 shows the characteristics of pump cycle during pump loss of prime.

FIG. 5 shows the characteristics of pump cycle during pump loss of prime. The purpose of these graphs is to demonstrate the sensor outputs when the pump loses prime and how this can be identified. In this case, a tap is turned on from time (a) to (b). The pressure at the high pressure transducer (15) declines to a predetermined pressure threshold (LP) which is reached at time (c) when the pump turns on. At time (d) the reservoir runs out of liquid and the pump draws air, thus causing a drop in pressure at the high pressure transducer (15) to what is shown as zero pressure at time (e). In fact, the pressure may not decline to zero, but rather to that corresponding to the minimum fluid head over the pressure transducer (15), given the plumbing configuration. Simultaneously, the pressure in the low pressure transducer (3) reaches a pressure corresponding to an open inlet pipe. In cases where the reservoir is low, a negative inlet pressure is likely to exist at transducer (3) before air is drawn and the pressure rises. In cases where the reservoir is high, the pressure at the inlet will decline to that existing with an open inlet pipe. The pump remains on until time (f). During this period the controller detects the lack of prime condition because the pump is running but the only pressure existing at transducer (3) is that associated with the static head in the plumbing. At the same time, the inlet pressure transducer has reached a pressure corresponding to air pressure at the reservoir. This state corresponds uniquely with a lack of prime condition.

It should be noted that the use of an additional pressure transducer to read the pump's outlet pressure would assist still further in the detection of lack of prime. In this case, the inlet pressure transducer (3) and the other pressure transducer would show almost the same pressure when the pump is running without liquid within the pump. The actual pressure difference would be that caused by the pump running with air or gas as the fluid. This would be much less than the pressure generated when liquid fills the pump in the primed situation.

Figure 6:
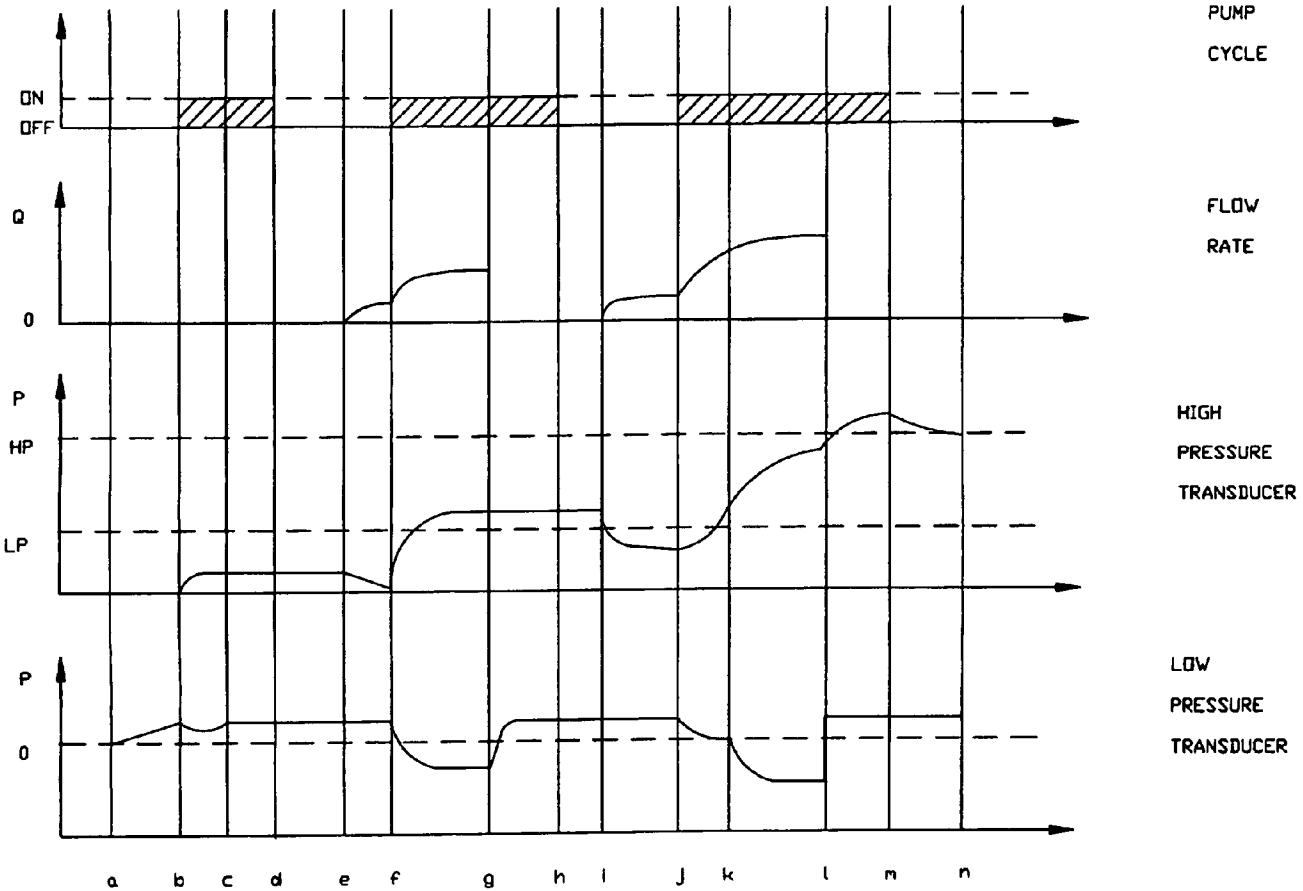
FIG. 6 shows the characteristics of pump recovery from prime following reservoir filling without the use of a de-airing valve.

FIG. 6 shows the characteristics of pump recovery from prime following reservoir filling, without the use of a de-airing valve. The purpose of this figure is to show how the sensors respond and how the pump can be switched to regain prime without the use of a remotely operated de-airing valve.

Prior to the time represented by (a) the reservoir is empty, and hence the low pressure transducer (3) shows no pressure. The high pressure transducer also shows zero pressure as the downstream plumbing has been drawn down. From time (a)

to (b) the reservoir fills and the low pressure transducer (3) pressure rises to reflect this condition. When adequate head has been generated over the low pressure transducer (3), the controller (22) turns the pump on. Provided some liquid reaches the pump inlet, the pump will partially pressurise and the pressure will reach a low stable level as can be seen from the high pressure transducer trace. The lack of pressure rise is a signal to turn the pump off at time (d). The pressure level in the accumulator (17) measured by the high pressure transducer (18) permits flow to occur at time (e), when a tap (21) is opened in the downstream plumbing. The resulting drop in pressure at the high pressure transducer (15) causes the controller to turn on the pump at (f). This leads to a drop in pressure at the low pressure transducer (3) that may go into negative pressure, and a rise in the high pressure level. When the tap is turned off at (g) the pump continues to operate until the controller recognises that the pressure at the high pressure transducer (15) is not increasing. The controller then switches off the pump at time (h). A further demand for liquid occurs at time (i). This demand is provided by the accumulator (17) which drops pressure as measured by high pressure transducer (15) until the controller turns on the pump at (j). The operation of the pump raises the pressure in the downstream plumbing and lowers it in the inlet plumbing (2) as measured at the low pressure transducer (3). At time (k) the pump (5) fully primes and the pump delivery characteristics changes significantly. The demand for liquid ceases at time (l) and the pump can now pressurise the accumulator fully. The pump turns off at time (m) when the pressure rise at the high pressure transducer (15) has ceased. There is a minor adiabatic cooling of the gas in the accumulator which leads to a pressure drop to time (n).

Figure 7:
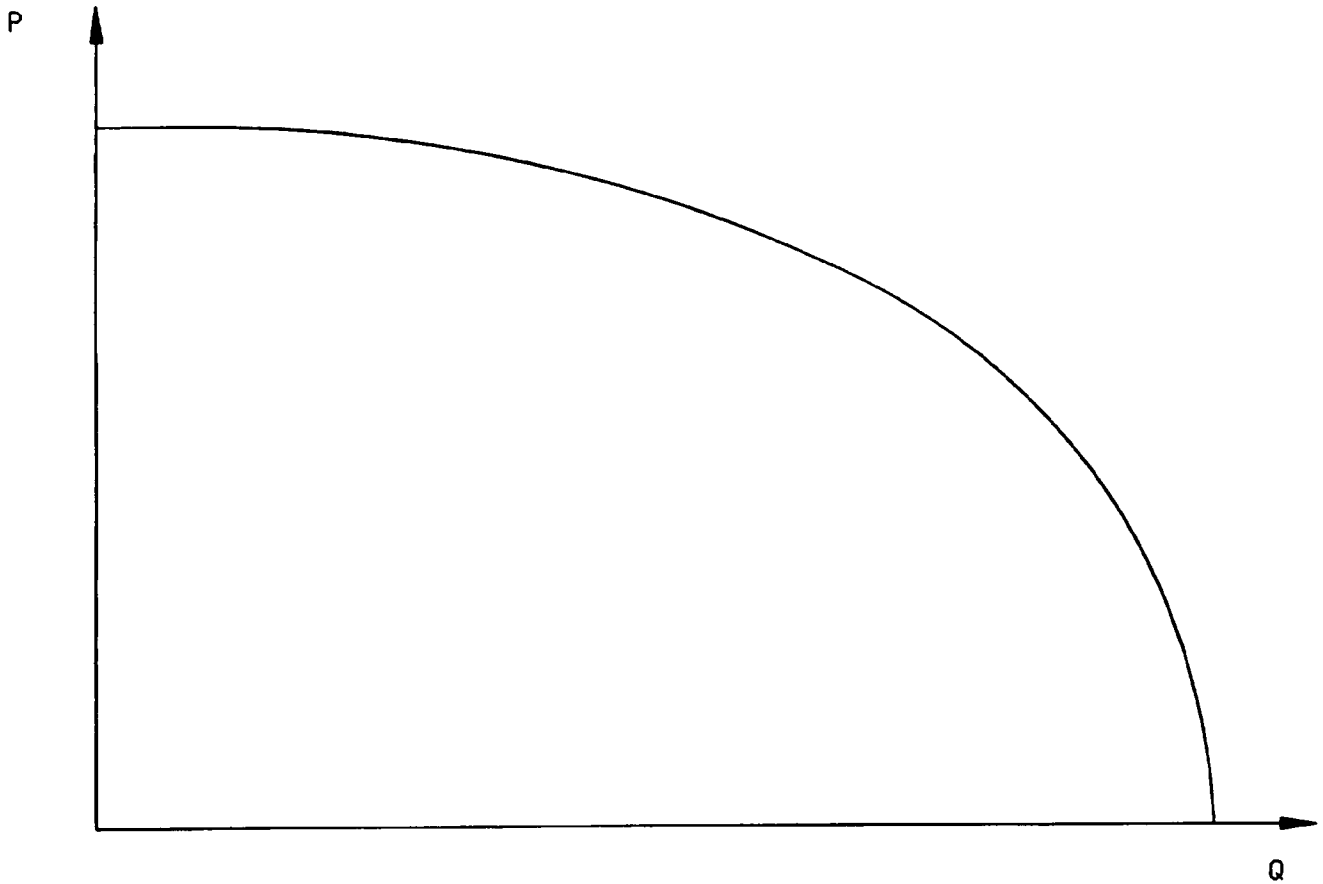
FIG. 7 shows the typical pressure versus flow rate characteristic of a centrifugal pump.

FIG. 7 shows the outlet pressure versus flow characteristic of a centrifugal pump. Noteworthy is the reduction in flow with increasing pressure.

Figure 8:
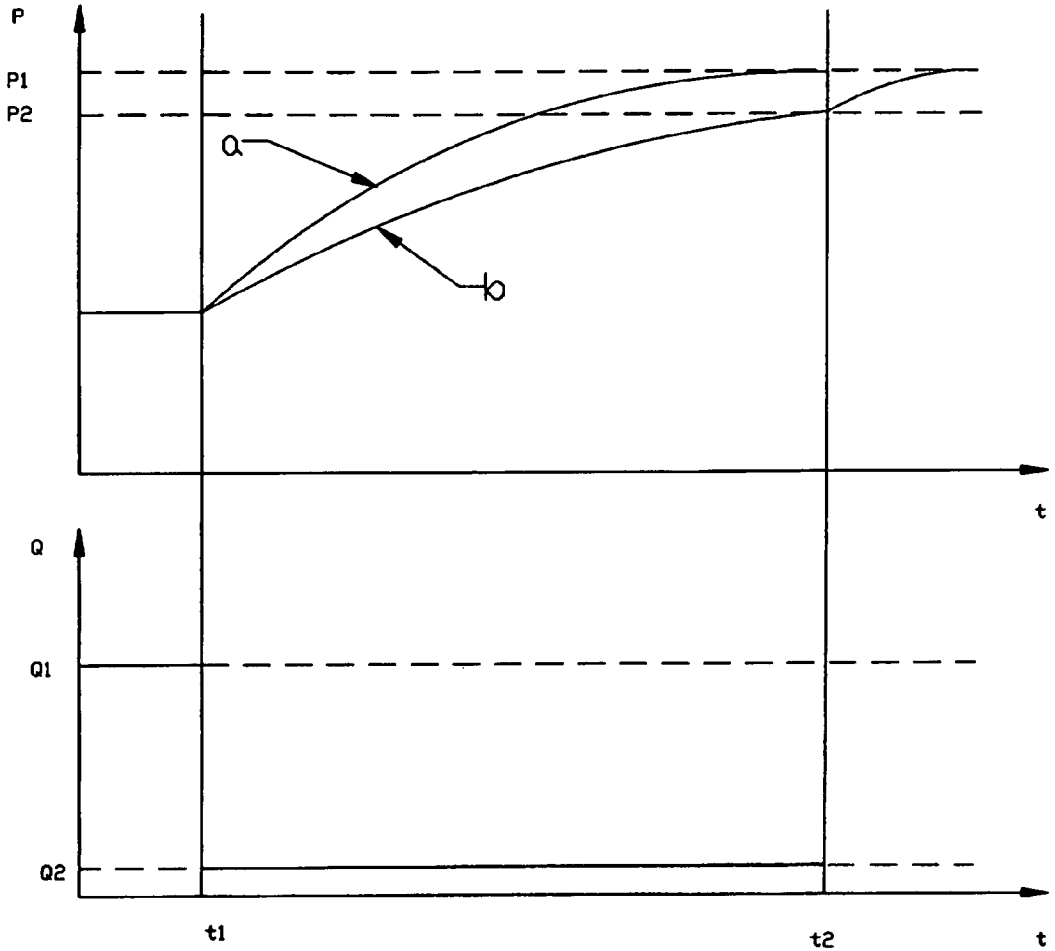
FIG. 8 shows the pressure versus time characteristic of a pump under conditions of different flow.

FIG. 8 shows two graphs. The lower graph is of flow versus time and shows an initial flow Q1 which either ceases at time (t1), or continues at the reduced rate Q2 to time (t2). The upper graph shows the outlet pressure of the pump versus the same time base as the lower graph. The pressure is constant until time t1 when in case (a) the flow ceases and the pressure rises to pressure p1. In the second case (b), the flow continues at rate Q2 with the result that the pressure only reaches P2 and takes longer to do so. When Q2 ceases due the pressure of case (b) rises to P1. This figure demonstrates how high pressure rise level and rate can be used to determine whether flow from a pump is occurring. These techniques are most effective when used close to the maximum pump pressure because the flow rate is lowered.

While the preferred and other embodiments of the invention have been disclosed with reference to a specific pump system and corresponding components, it is to be understood that many changes in detail may be made as a matter of engineering and programming choices, without departing from the spirit and scope of the invention, as defined by the appended claims.

What is claimed is:

1. A method of controlling a pumping system of the type having a reservoir holding a supply of a liquid available to an inlet of a pump, an outlet of the pump providing pressurised liquid via a non-return valve to an accumulator and to one or more users of the liquid, an outlet pressure transducer providing a signal indicating a pressure on an outlet side of the pump, and a controller for controlling the operation of the pump as a function of the signal of the outlet pressure transducer, the method characterised by:

storing a high pressure level in a memory of the controller indicating an outlet liquid pressure in which the pump should be stopped, and storing a low pressure level in the memory of the controller indicating an outlet liquid pressure in which the pump should be started;

storing in the memory an indication of a trigger flow rate exceeding a nominal flow rate of liquid used by the user;

sampling the signals produced by the outlet pressure transducer and processing the sampled signals by the controller to produce an indication of the flow rate of the liquid used by the user; and comparing the processed flow rate with the trigger flow rate and if the processed flow rate exceeds the trigger flow rate, turning on the pump even if the liquid pressure at the pump outlet is higher than the stored low pressure level.

2. The method of claim 1, further including storing the sampled signals and processing the sampled signals to determine a slope indicative of the flow rate of liquid used by the user.

3. The method of claim 2, further including storing the trigger flow rate as a slope.

4. The method of claim 3, further including comparing the stored trigger slope with the processed slope and starting the pump if the liquid used by the user exceeds the flow rate indicated by the stored trigger slope.

5. The method of claim 1, further including storing samples of the outlet pressure transducer signal and comparing a group of samples to determine a flow rate, and comparing one or more samples of the outlet pressure transducer signal with the high pressure level and the low pressure level to control the pump.

6. The method of claim 1, further including maintaining the pump operational until the pressure at the pump outlet exceeds the high pressure level by a predetermined amount.

7. The method of claim 1, wherein said pumping system further includes an inlet pressure transducer for sensing liquid pressure at an inlet of the pump and providing the controller a signal indicative of a liquid pressure at the inlet of the pump, and further including the step of sensing the static liquid pressure during a non-operational period of the pump, and processing the static liquid pressure indication to provide an indication of a level of the liquid in the reservoir.

8. A pumping system for pumping water from a water supply to a plumbing system, comprising:

a pump for pumping water from the water supply to the plumbing system;

an accumulator coupled to an outlet side of said pump for holding a temporary supply of pressurized water for use by the plumbing system;

a pressure sensor for sensing water pressure at an outlet side of said pump;

means for sensing a flow rate of water to the plumbing system;

a control responsive to said flow sensing means for controlling the pump, said control receiving an electrical signal from said pressure sensor to sense a low water pressure level;

said control sensing said flow sensing means indicating a flow rate exceeding a nominal flow rate of water demanded by the plumbing system; and in response to said water flow rate indication, said control turning on said pump to pump water from said water supply to said plumbing system before a low water pressure level at the outlet side of said pump is sensed.

9. The pumping system of claim 8, wherein said pump is turned on by said control in response to a high water flow rate to maintain the demand for water by the plumbing system before a low pressure indication is produced by said pressure sensor.

10. The pumping system of claim 8, wherein said controller is adapted to maintain said pump on until the pressure on the outlet side of said pump exceeds a predetermined high pressure level.

11. The pumping system of claim 8, further including a one-way valve connected between the outlet of said pump and said accumulator.

12. The pumping system of claim 11, wherein said flow sensing means is located down line of said accumulator.

13. The pumping system of claim 8, wherein said flow sensing means comprises a water flow rate sensor.

14. The pumping system of claim 8, wherein said flow sensing means comprises programming in said control for determining a rate of change of pressure of the water supplied to the plumbing system.

15. The pumping system of claim 8, wherein said control is programmed to turn on said pump in response to a demand for water by the plumbing system when i) said low water pressure level is reached and ii) when the flow rate of water supplied to the plumbing system is below said nominal flow rate.

16. A method of controlling a pumping system for pumping a liquid from a liquid supply to a plumbing system, comprising:

in response to a demand for liquid by the plumbing system exceeding a predetermined flow rate, and before a pressure on an outlet side of the pump decreases below a predetermined level, turning on a pump to pump liquid from the liquid supply to the plumbing system;

keeping the pump on until a pressure on an outlet side of the pump exceeds a predetermined level;

in response to a demand for liquid by the plumbing system below said predetermined flow rate, turning on said pump to pump liquid from the liquid supply to the plumbing system when a low liquid pressure is sensed on the outlet side of said pump; and whereby said pumping system operates differently in response to different demands for liquid by the plumbing system.

17. The method of claim 16, further including using an accumulator connected by a one-way valve to the outlet side of said pump for holding a temporary supply of pressurized liquid for use by the plumbing system.

18. The method of claim 16, further including sensing the flow of the liquid by a liquid flow sensor connected in series with the outlet of said pump.

19. The method of claim 16, further including sensing the flow of the liquid by measuring a rate of pressure decline in the liquid delivered to the plumbing system.

* * * * *